US005751147A

United States Patent [19]

Nakata et al.

[11] Patent Number: 5,751,147

[45] Date of Patent: May 12, 1998

[54] PREIGNITION DETECTING METHOD

[75] Inventors: Koichi Nakata; Kazuhisa Mogi, both of Susono; Youichi Kurebayashi, Toyohashi, all of Japan

[73] Assignee: Toyota Jidosha Kabushiki Kaisha, Aichi-ken, Japan

[21] Appl. No.: 864,627

[22] Filed: May 28, 1997

[30] Foreign Application Priority Data

May 30, 1996 [JP] Japan ..... 8-136923

[51] Int. Cl.[6] ..... F02P 17/00

[52] U.S. Cl. ..... 324/399; 324/391; 324/393; 123/425

[58] Field of Search ..... 324/378, 379, 324/380, 382, 393, 399, 402; 73/116, 117.2, 35.03, 35.04, 35.06; 340/664, 650; 123/406, 425, 479, 630; 364/431.03, 431.051, 431.055

[56] References Cited

U.S. PATENT DOCUMENTS

| | | | |
|---|---|---|---|
| 4,233,943 | 11/1980 | Rogora et al. | 123/425 |
| 4,846,129 | 7/1989 | Noble | 123/425 |
| 5,005,547 | 4/1991 | Suga et al. | 123/425 |
| 5,204,630 | 4/1993 | Seitz et al. | 324/399 |
| 5,521,509 | 5/1996 | Ishikawa et al. | 324/393 |
| 5,632,247 | 5/1997 | Hashizume et al. | 123/425 |

FOREIGN PATENT DOCUMENTS

| | | |
|---|---|---|
| 63-68774A | 3/1988 | Japan . |
| 4259671A | 9/1992 | Japan . |
| 587036A | 4/1993 | Japan . |
| 5223002A | 8/1993 | Japan . |

*Primary Examiner*—Vinh P. Nguyen
*Assistant Examiner*—Diep Do
*Attorney, Agent, or Firm*—Kenyon & Kenyon

[57] ABSTRACT

A preignition detecting method which prevents preignition (PI) from being misjudged as having occurred when an ignition plug is fouling. It is determined whether or not the ignition plug fouls in accordance with a voltage, developed across a detecting resistor which is fetched into a microcomputer 18 at a relatively early timing after an ignition command signal is outputted from an ignition device. Further it is determined whether or not preignition occurs in accordance with another voltage fetched at a relatively late timing after the ignition command signal is outputted. When it is determined that the ignition plug is fouling, it is inhibited to fetch the another voltage at a relatively late timing to prevent a misjudgment that preignition occurs due to a leakage current from being caused though preignition does not actually occur.

8 Claims, 10 Drawing Sheets

PREIGNITION DETECTING METHOD

BACKGROUND OF THE INVENTION

1. Field of the Invention

The present invention generally relates to a preignition detecting method, and, more particularly, to a preignition detecting method enabled to reliably detect preignition even when an ignition plug fouls.

2. Prior Art

Preignition is defined as the phenomenon that an air-fuel mixture is spontaneously ignited during the compression stroke by residual heat contained in deposits which adhere to the ignition plug and/or an inner wall of an engine cylinder.

Preignition causes not only a sharp decrease of the output of an engine and/or a fluctuation of the engine speed, but can also damage the engine at the worst.

Thus, hitherto, there have been proposed various kinds of preignition detecting devices. One such preignition detecting device is an ion current detecting device.

Namely, the ion current detecting device detects a misfire based on the electric current generated when the electrical charge charged in a capacitor discharges through ions generated in air-fuel mixture if the mixture is normally ignited by sparking of the ignition plug. However, it has already been disclosed that it can be determined that a preignition occurs, if an ion current is detected prior to ignition caused in response to an ignition command signal because ions are generated in an air-fuel mixture even when the preignition occurs (see the Japanese Unexamined Patent Publication (Kokai) No. 63-68774).

Misjudgment that a preignition has occurred may be caused when an ignition plug fouls due to adhesion of a carbide of an additional agent contained in the fuel or lubricant, because a leakage current is generated when the ignition command signal is on due to deterioration of the insulation of the ignition plug.

FIGS. 2(A) to 2(D) are diagrams for illustrating a problem to be solved by the present invention. The upper part of each of these four graphs represents the waveform of an ignition command signal. The lower part of each of these four graphs represents the waveform of a signal flowing through a secondary circuit.

FIG. 2(A) illustrates the case that an air-fuel mixture is normally ignited by discharging an ignition plug. First, impulses are generated in the secondary circuit in response to the leading edge and the falling edge of the ignition command signal, respectively. Thereafter, noises due to the discharge of the ignition plug are produced. Subsequently, an ion current is generated.

FIG. 2(B) illustrates a case where preignition occurs. As compared with FIG. 2(A), the width of a pulse generated in response to the falling edge of the ignition command signal becomes larger.

FIG. 2(C) illustrates a case where the ignition plug fouls. A leakage current flows through the secondary circuit in response to the leading edge of the ignition command signal. In addition, even after the discharge of the ignition plug, a leakage current flows therethrough.

FIG. 2(D) illustrates a case where the ignition plug fouls and preignition occurs. A pulse generated in response to the leading edge of the ignition command signal merges into another pulse generated in response to the falling edge of the ignition command signal. Consequently, a pulse caused by the preignition cannot be distinguished from the other pulse.

The present invention is accomplished in view of the aforementioned problem of the prior art.

SUMMARY OF THE INVENTION

Accordingly, an object of the present invention is to provide a preignition detecting method which can prevent preignition from being misjudged when an ignition plug fouls.

To achieve the foregoing object, according to one aspect of the present invention, there is provided a preignition detecting method which comprises the steps of: an ignition command signal output step for outputting an ignition command signal from an ignition device; a fouling detecting step for detecting fouling of an ignition plug in accordance with an ion current flowing between an ignition plug and the ground during a fouling detecting period in which an ignition command signal is being outputted at said ignition command signal output step; a preignition detecting step for detecting a preignition in accordance with the ion current flowing between the ignition plug and the ground during a preignition detecting period in which the ignition command signal is being outputted at said ignition command signal output step, later than said fouling detecting period; and a preignition detection inhibiting step for inhibiting said preignition detecting step from being performed, when it is determined that the ignition plug is fouling at said fouling detecting step.

According to this method, when the ion current is detected at a relatively earlier time after the ignition command signal has been outputted, it is determined that the ignition plug is fouling and misjudgment that a preignition occur may be caused. Consequently, the detection of ion current for detecting preignition, which is performed at a relatively later time after the ignition command signal has been outputted, is inhibited.

According to another aspect of the present invention, there is provided a preignition detecting method, which further comprises a step of an inhibiting step for inhibiting said fouling detecting step from being performed until the preignition is not detected, at said preignition detecting step, once a preignition has been detected at said preignition detecting step.

According to the second method of the present invention, the detection of an ion current for detecting fouling is inhibited to prevent a misjudgment that the ignition plug fouls from being caused due to an advance of ignition timing once preignition has been detected.

According to another aspect of the present invention, there is provided a preignition detecting method which comprises: an ignition command signal output step for outputting an ignition command signal from an ignition device; an integrating step for integrating an ion current, which flows between an ignition plug and the ground during a predetermined period in which an ignition command signal is being outputted at said ignition command signal output step; and the judgment step for judging that preignition has occurred, if an integrated value is not more than a predetermined fouling detecting threshold and is not less than a predetermined preignition detecting threshold smaller than the fouling detecting threshold.

In the case of this method it is determined whether or not fouling and preignition have occurred according to the integrated value of the ion current detected when the ignition command signal is being outputted.

According to a further aspect of the present invention, there is provided a preignition detecting method which further comprises: an operating-condition transition detecting step for detecting that a transition of the operating condition of an internal combustion engine to a specific operating condition, where preignitions often occur, from an operating condition other than the specific operating condition where preignitions rarely occur, has occurred; and a changing step for inhibiting said preignition detecting step from being performed, when it is determined that the ignition plug is fouling at said fouling detecting step after the transition of the operating condition is detected at said operating-condition transition detecting step, and for inhibiting said fouling detecting step from being performed, but removing the inhibition of said preignition detecting step after fouling has not once been detected.

Thus, according to this method either one of said fouling detecting step and said preignition detecting step is performed after the transition of the operating condition of the internal combustion engine to the specific operating condition where preignitions often occur has been caused.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF THE PREFERRED EMBODIMENTS

Hereinafter, the preferred embodiments of the present invention will be described in detail by referring to the accompanying drawings.

Figure 1:
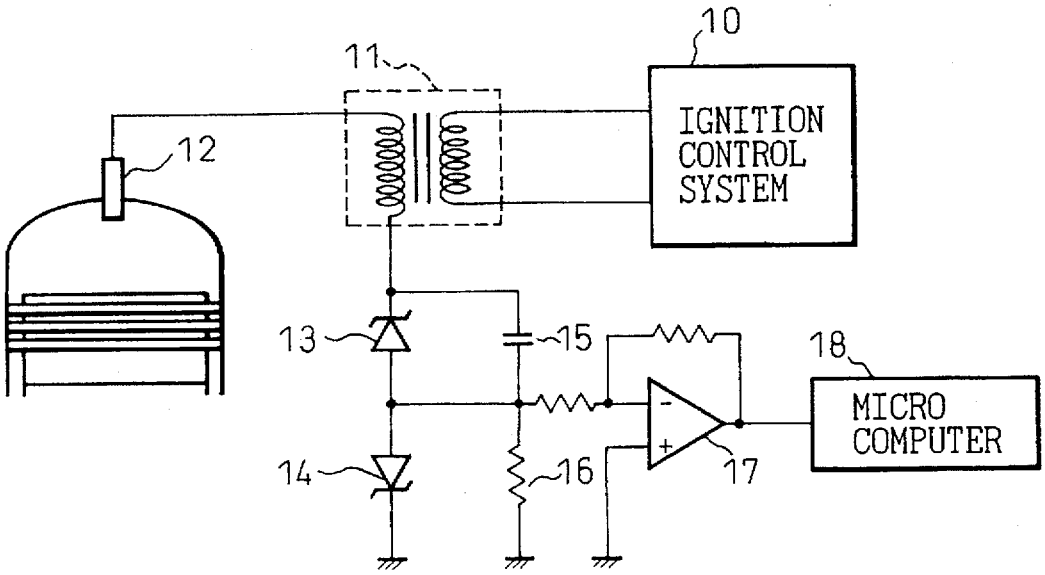
FIG. 1 is a circuit diagram illustrating the configuration of an ion current detecting device.
Figure 2A:
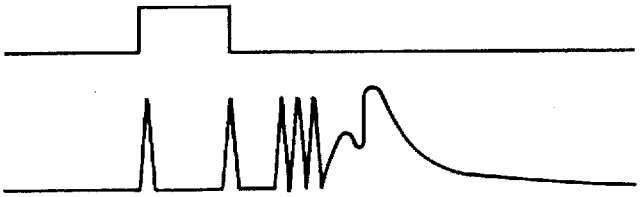
FIGS. 2(A) to 2(D) are diagrams for illustrating the problem to be solved by the present invention.
Figure 2B:
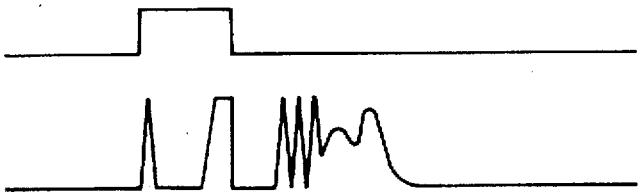
Figure 2C:
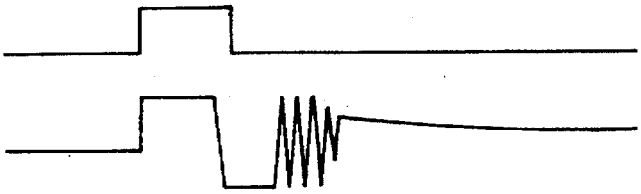
Figure 2D:
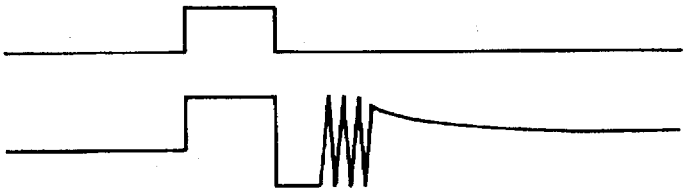

FIG. 1 is a circuit diagram illustrating the configuration of an ion current detecting device for performing a preignition detecting method of the present invention. An ignition command signal is applied to an ignition coil 11 from an ignition device 10.

The secondary winding of the ignition coil 11 has two terminals, one terminal is connected to an ignition plug 12 and the other is connected to the ground through the series of first and second Zener diodes 13, 14, cathode electrodes thereof being directly connected.

Further, a capacitor 15 is connected in parallel with the first Zener diode 13. A detecting resistor 16 is connected in parallel with the second Zener diode 14.

Furthermore, a voltage developed across the detecting resistor 16 is supplied to a microcomputer 18 through an inverting amplifier 17.

In this circuit, when a pulse-like ignition command signal is outputted from the ignition device 10 to the primary winding of the ignition coil 11, a high voltage induced in the secondary winding of the ignition coil 11 at the falling edge of the ignition command signal causes the ignition plug 12 to discharge. Simultaneously, the capacitor 15 is charged with the voltage regulated by the first Zener diode 13.

Namely, after charging the capacitor 15, the ion current detecting circuit is driven by using the capacitor 15 as a power supply.

Figure 3:
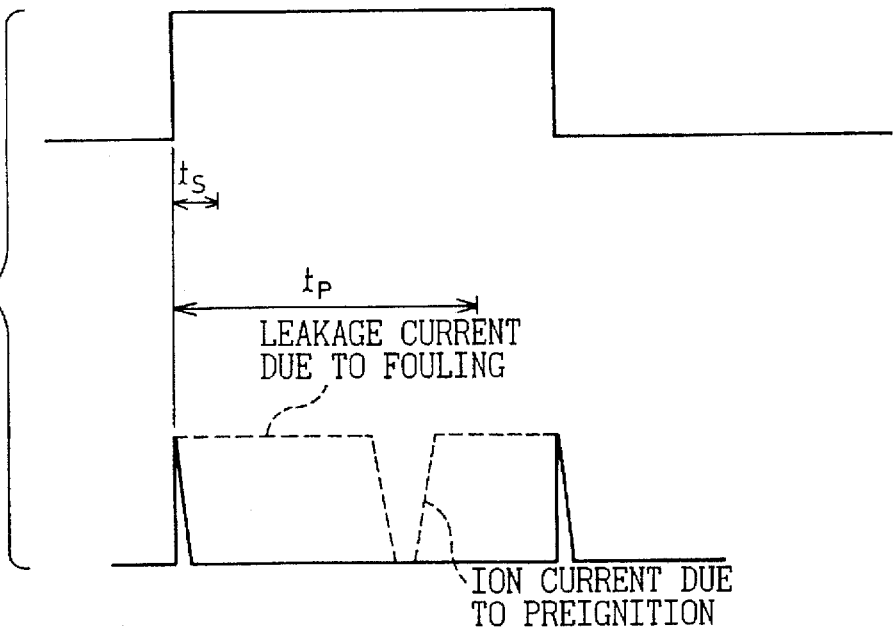
FIG. 3 is a diagram for illustrating a preignition detecting method.

FIG. 3 is a diagram of illustrating a preignition detecting method according to the present invention. Two voltages across the detecting resistor 16 are fetched into the microcomputer, one is a fouling detecting voltage $V(t_s)$ fetched when a first fixed interval ts has elapsed after the pulse-like ignition command signal has been outputted, and the other is a preignition detecting voltage $V(t_p)$ fetched when a second fixed interval tp longer than the first interval ts has elapsed.

If the fouling detecting voltage $V(t_s)$ is higher than a predetermined fixed threshold voltage, the determination whether or not a preignition occurs is inhibited because a misjudgment may occur due to fouling.

Conversely, if the fouling detecting voltage $V(t_s)$ is lower than the predetermined threshold voltage, it is determined whether or not preignition occurs according to the preignition detection time voltage $V(t_p)$ because a misjudgment never occurs due to fouling.

Note, the first predetermined time, namely, a fouling detecting interval $t_s$ is set as a relatively short interval for the ignition command signal is outputted, for example, about 1 milliseconds (ms) after the ignition command signal rises. And, the second predetermined time, namely, a preignition detecting period $t_p$ is set as a relatively long interval for the ignition command signal is outputted, for example, an interval until a time elapses to a moment corresponding to 5 degrees crank angle before the (pulse-like) ignition command signal falls.

Figure 4:
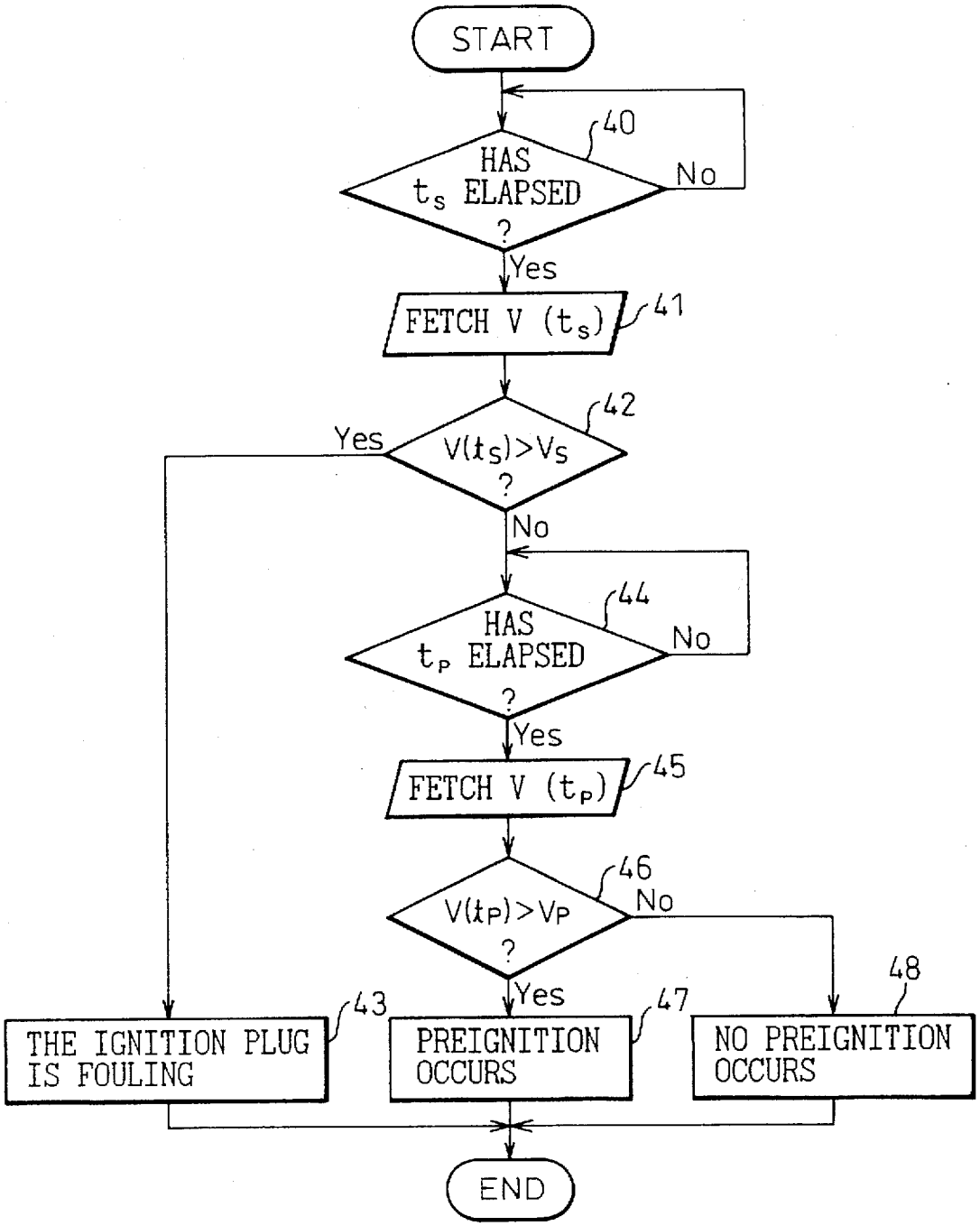
FIG. 4 is a flowchart of a first preignition detecting routine.

FIG. 4 is a flowchart of a first preignition detecting routine executed by the microcomputer 18. This routine is executed every time an ignition command signal is outputted from the ignition device 10.

At step 40, the control waits until the fouling detecting interval $t_s$ has elapsed.

When the fouling detecting interval $t_s$ has elapsed, the determination at step 41 is affirmative, and the fouling detecting voltage $V(t_s)$ is fetched into the microcomputer 18.

At step 42, it is determined whether the fouling detection voltage $V(t_s)$ is higher than a predetermined fouling detecting threshold voltage $V_s$. When the determination at step 42 is affirmative, this routine is terminated after it is determined that the ignition plug fouls at step 43 without determining whether or not the preignition occurs to prevent the misjudgment from being caused.

When the determination at step 42 is negative, the control waits until the preignition detecting period has elapsed because a misjudgment never occurs if the ignition plug does not foul.

When the preignition detecting interval $t_p$ has elapsed, the determination at step 44 is affirmative and data representing the preignition detecting voltage ($t_p$) is fetched into the microcomputer 18 at step 45.

It is determined whether the preignition detecting voltage $V(t_p)$ is higher than a predetermined preignition detecting threshold voltage $V_p$. When the determination at step 46 is affirmative, that is, when the preignition detecting voltage $V(t_p)$ is higher than the predetermined preignition detecting threshold voltage $V_p$, it is determined that preignition has occurred at step 47. Then, this routine is terminated.

Conversely, when the determination at step 46 is negative, that is, when the preignition detecting voltage $V(t_p)$ is lower than the predetermined preignition detecting threshold voltage $V_p$, this routine is terminated after it is determined that preignition has not occurred at step 48.

In the first preignition detecting routine, the voltages are fetched twice while one ignition command signal is outputted. However, if a preignition has once occurred, a preignition may not be detected, because an ignition timing gradually advances to a fouling detecting timing if an operation to avoid a preignition is not performed and the fouling detecting voltage $V(t_s)$ becomes higher than the predetermined fouling detecting threshold voltage $V_s$ so that it is determined the ignition plug fouls though it does not actually foul. Further, when the fouling detecting timing becomes near to the ignition detecting time, a load for fetching voltages may become excessive high.

Figure 5:
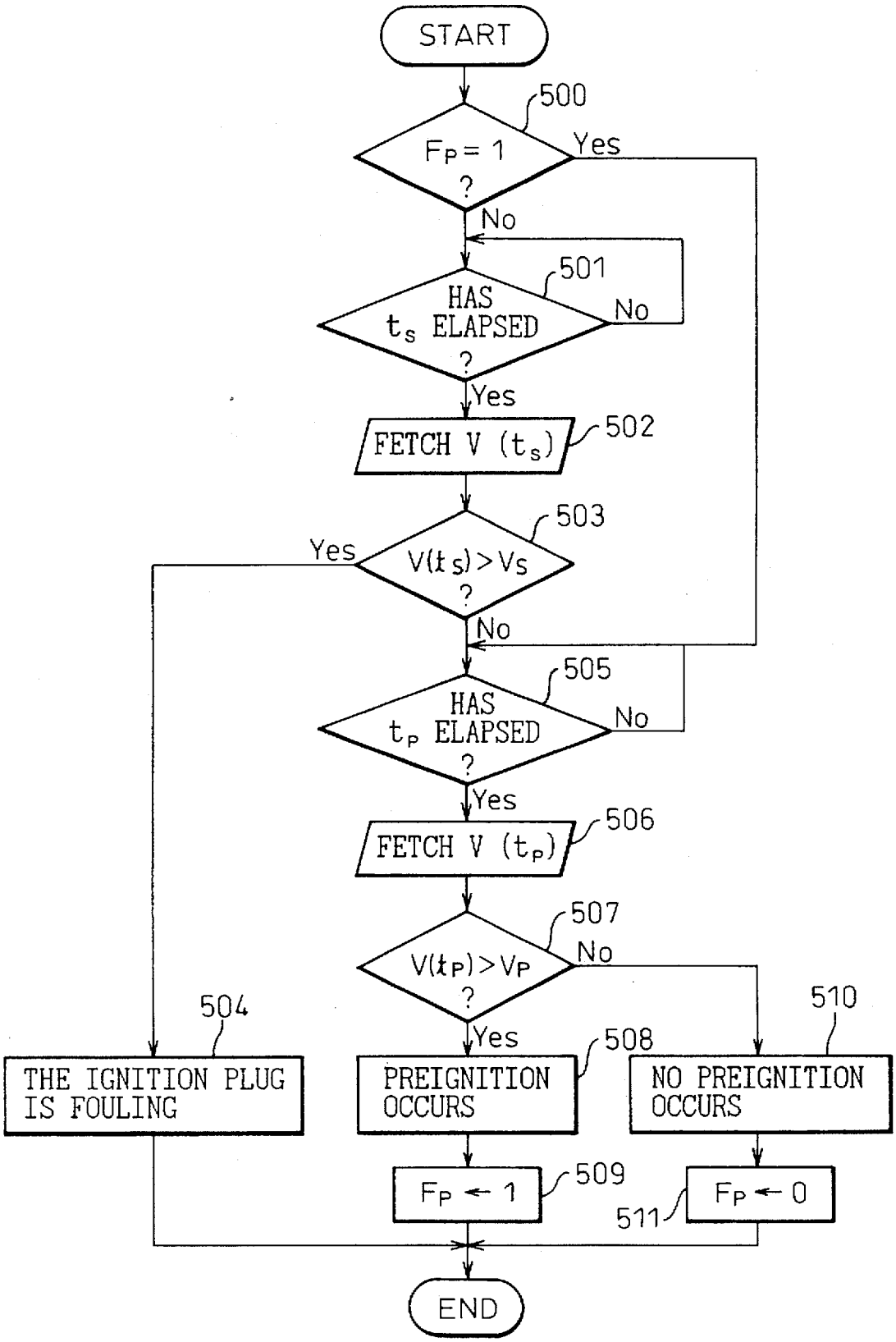
FIG. 5 is a flowchart of a second preignition detecting routine.

A second preignition detecting routine shown in FIG. 5 is to solve the problem described hereinabove and is executed every time an ignition command signal is outputted from the ignition control system 10.

It is determined whether or not a preignition flag $F_p$ is set to "1".

When the determination at step 500 is negative, namely, when it is not determined that preignition occurs, the control waits until the fouling detecting interval $t_s$ has elapsed.

When the fouling detecting interval $t_s$ has elapsed, the determination at 501 is affirmative. Then, the fouling detecting voltage $V(t_s)$ is fetched into the microcomputer 18 at step 503.

At step 503, it is determined whether the fouling detecting voltage $V(t_s)$ is higher than a predetermined fouling detecting threshold voltage $V_s$. When the determination at step 503 is affirmative, it is determined that the ignition plug 12 fouls at step 504. Then, this routine is terminated without determining whether or not preignition occurs, order to prevent a misjudgment from being caused.

Conversely, when the determination at step 503 is negative, the control waits at step 505 until the preignition detecting internal $t_p$ has elapsed.

Note, when the determination at step 500 is affirmative, namely, when it is determined that preignition occurs, the control proceeds to step 505 without fetching fouling detecting voltage $V_s$ to reduce loads imposed on the microcomputer 18.

When the preignition detecting interval $t_p$ has elapsed, the determination at step 505 is affirmative, and the preignition detecting voltage ($t_p$) is fetched into the microcomputer 18.

It is determined whether the preignition detecting voltage $V(t_p)$ is higher than the predetermined preignition detecting threshold voltage $V_p$. When the determination at step 507 is affirmative, that is, when the preignition detecting voltage $V(t_p)$ is higher than the predetermined preignition detecting threshold voltage $V_p$, after it is determined that preignition has occurred at step 508 and the preignition occurrence flag is set to "1" at step 509, this routine is terminated.

Conversely, when the determination at step 507 is negative, that is, when the preignition detecting voltage $V(t_p)$ is lower than the predetermined preignition detecting threshold voltage $V_p$, after it is determined that no preignition occurs at step 510, and the preignition flag is reset to "0", this routine is terminated.

In the first preignition detecting routine, if the fouling detection voltage $V(t_s)$ is higher than the predetermined fouling detecting threshold voltage $V_s$, it is determined that the ignition plug fouls. Moreover, if the preignition detecting voltage $V(t_p)$ is more than the predetermined preignition detecting threshold voltage $V_p$, it is determined that preignition occurs. However, when noises are superposed on the voltage when fetching it, misjudgment may be caused.

Third preignition detecting routine has been developed to solve the problem described hereinabove. This routine can eliminate the influence of noises by detecting a fouling and preignition according to the integrated value of a voltage developed across the detecting resistor 16, which is obtained by integrating the voltage when the ignition command signal is being outputted.

Figure 6:
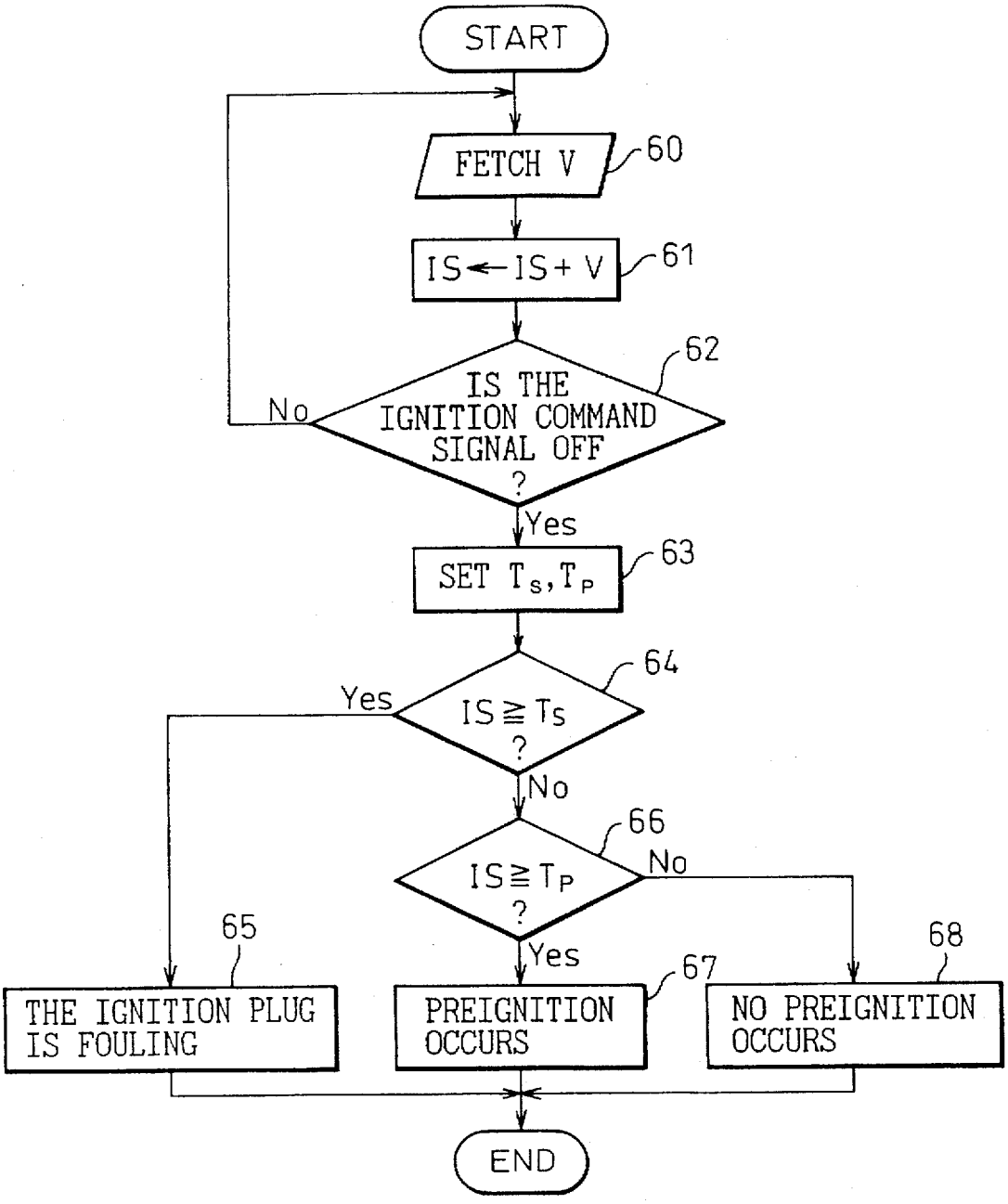
FIG. 6 is a flowchart of a third preignition detecting routine.

The third preignition detecting routine shown in FIG. 6 is executed every time an ignition command signal is outputted from the ignition device 10. The voltage developed across the detecting resistor 16 is fetched at step 60.

Then, the integrated value IS of the voltage V is obtained by using the following equation at step 61.

$$IS \leftarrow IS+V$$

At step 62, it is determined whether or not the ignition command signal is off. When the determination is negative, namely, when the ignition command signal is on, the control returns to step 60.

When the ignition command signal is off, the determination at step 62 is affirmative, and the control proceeds to step 63 where a fouling detecting value $T_s$ and a preignition detecting value $T_p$ are set.

Note, when the ignition plug fouls, a leakage current flows throughout a period when an ignition command signal is outputted, whereas when preignition occurs, a current flows only for a latter half of the period when an ignition command signal is outputted. Thus, the fouling detection value $T_s$ becomes larger than the preignition detection value $T_p$.

Note, the fouling detecting value $T_s$ and the preignition detecting value $T_p$ may be determined as fixed values, or as functions of the engine speed or the temperature of cooling water.

When threshold values are defined as functions of the engine speed, the higher the engine speed becomes, the smaller these threshold values are set, because the higher the engine speed becomes, the smaller the integrated voltage becomes.

When threshold values are defined as functions of the temperature of cooling water, the lower the temperature of the cooling water becomes, the smaller the fouling detecting value $T_s$ is set, because the lower the temperature becomes, the more often the ignition plug fouls. Conversely the higher the temperature becomes, the smaller the preignition detecting value $T_p$ is set, because the higher the temperature becomes, the more often preignition occurs.

At step 64, it is determined whether or not the integrated value IS is larger than the fouling detecting value $T_s$. When the determination is affirmative, namely, when the integrated value IS is larger than the fouling detecting value $T_s$, after it is determined that the ignition plug fouls at step 65, this routine is terminated.

Conversely, when the determination at step 64 is negative, namely, when the integrated value IS is smaller than the fouling detecting value $T_s$, the control proceeds to step 66 where it is determined whether or not the integrated value IS is bigger than the preignition detecting value $T_p$.

When the determination at step 66 is affirmative, namely, when the integrated value IS is smaller than the fouling detecting value $T_s$ and is not smaller than the preignition detecting value $T_p$, it is determined that preignition has occurred at step 67. Then, this routine is terminated.

When the determination at step 66 is negative namely, when the integrated value IS is smaller than the preignition detecting value $T_p$, it is determined that the condition is normal at step 68. Then, this routine is terminated.

In the first preignition detecting routine, the voltages are twice read when the ignition command signal is being outputted, regardless of the operating condition of the internal combustion engine. Thus, when the engine speed becomes high, the intervals between the times when the voltages are read, become shorter, and the load required to the microcomputer 18 cannot be prevented from becoming high.

A fourth preignition detecting routine has been developed to solve the problem described hereinabove. An object of the fourth preignition detecting routine is to reduce the load required to the microcomputer 18 by inhibiting the determination whether or not the ignition plug fouls when the operating condition of the internal combustion engine is transferred to the specific operating condition in which preignitions often occur.

Figure 7:
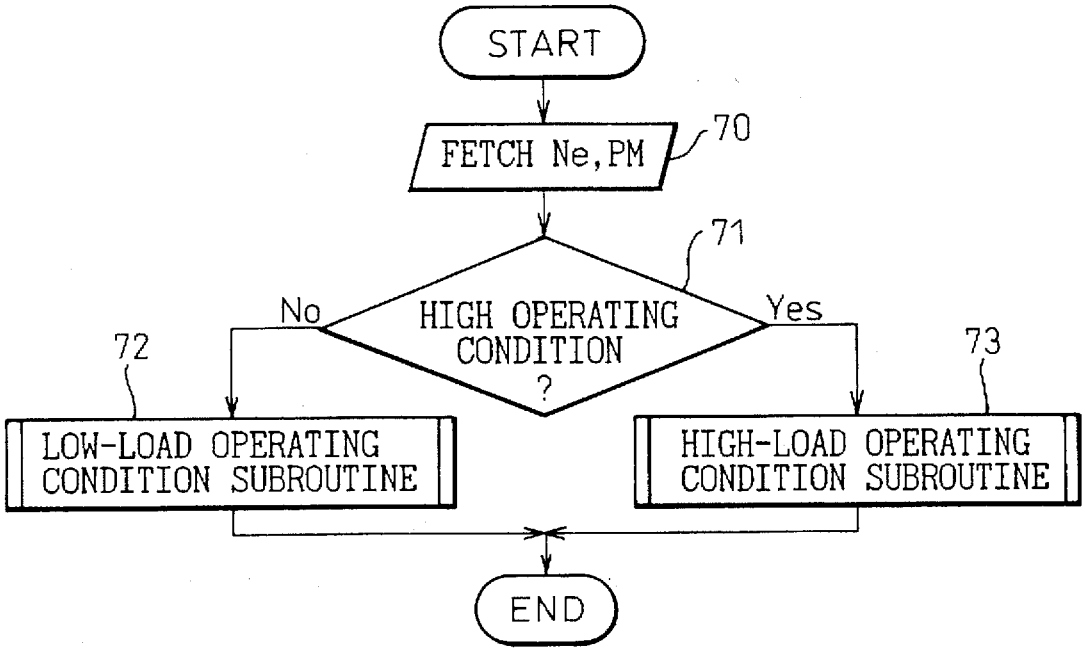
FIG. 7 is a flowchart of a fourth preignition detecting routine.

FIG. 7 is a flowchart of a fourth preignition detecting routine executed every time an ignition command signal is outputted.

At step 70, the engine speed $N_e$ of the engine and the intake manifold pressure PM are fetched into the microcomputer 18. At step 71, it is determined whether or not the operating condition of the internal combustion engine is a high-load operating condition.

Figure 8:
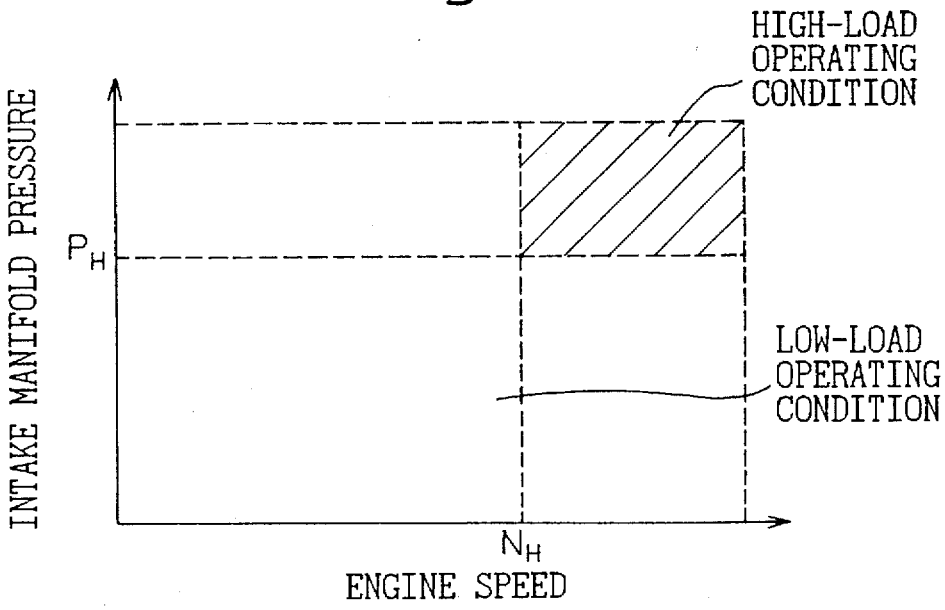
FIG. 8 is a graph for determining an operating condition of an internal combustion engine.

FIG. 8 is a graph for determining the operating condition of the internal combustion engine. In this graph, the abscissa denotes the engine speed $N_e$, and the ordinate denotes the intake manifold pressure PM when the engine speed $N_e$ is higher than a predetermined engine speed $N_H$ and the intake manifold pressure PM is higher than a predetermined pressure $P_H$, the operating condition of the engine is determined as the high-load operating condition. Otherwise, the operating condition of the engine is determined as the low-load operating condition.

If the determination at step 71 is negative, that is, if the internal combustion engine is in the low-load operating condition, this routine is terminated after the low-load operating condition subroutine is executed at step 72. Conversely, if the determination at step 71 is affirmative, that is, if the internal combustion engine is in the high-load operating condition, this routine is terminated after the high-load operating condition subroutine is executed at step 73.

Figure 9:
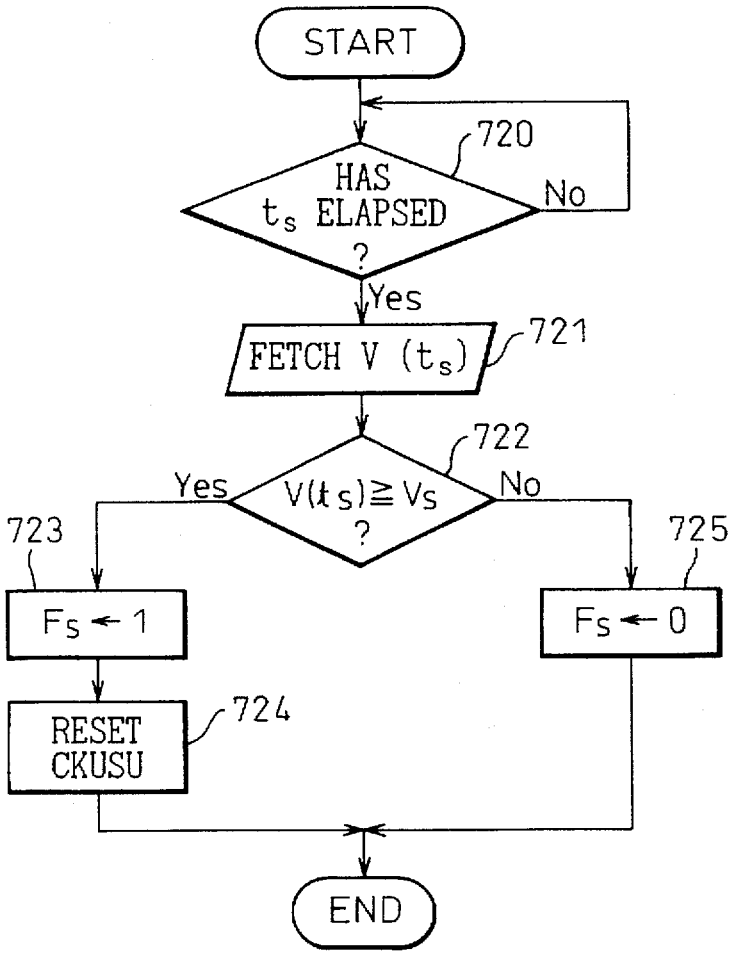
FIG. 9 is a flowchart of a low-load operating condition subroutine.

FIG. 9 is a flowchart of the low-load operating condition subroutine executed at step 72. At step 720, the control waits until the fouling detecting time $t_s$ has elapsed.

When the fouling detecting time $t_s$ has elapsed, the determination at step 720 is affirmative, and the control proceeds to step 721 where the fouling detecting voltage $V(t_s)$ is fetched.

At step 722, it is determined whether the fouling detecting voltage $V(t_s)$ is higher than the predetermined fouling detecting threshold voltage $V_s$.

When the determination at step 722 is affirmative, it is determined that the ignition plug is fouling and the fouling flag $F_s$ is set to "1" at step 723. Then, this routine is terminated after a counter CKUSU is reset at step 724.

Conversely, when the determination at step 722 is negative, it is determined that the ignition plug is not fouling. Then, this routine is terminated after the fouling flag $F_s$ is reset to "0" at step 725.

Note, in the low-load operating condition subroutine, the preignition detecting voltage is not fetched because no preignition occurs in the low-load operating condition.

Figure 10:
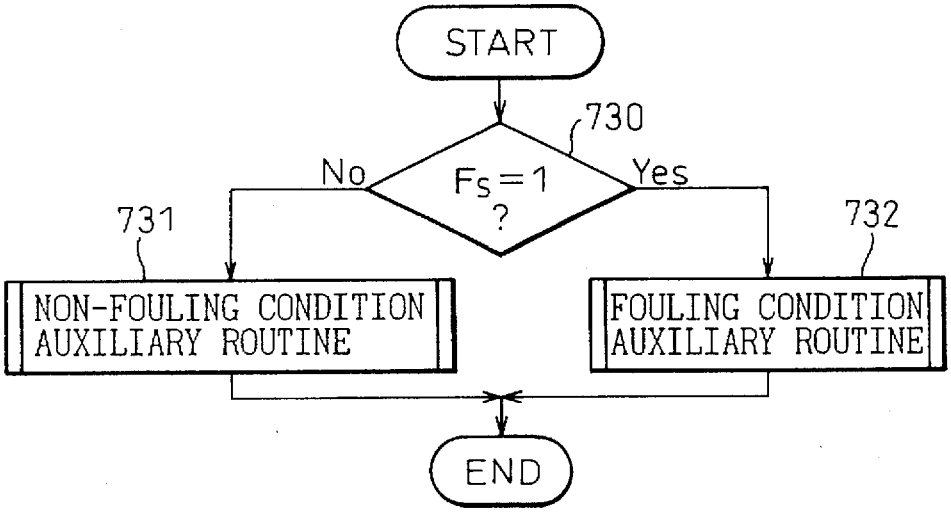
FIG. 10 is a flowchart of a high-load operating condition subroutine.

FIG. 10 is a flowchart of the high-load operating condition subroutine executed in step 73. At step 730, it is determined whether or not the fouling flag $F_s$ is "1".

When the determination at step 730 is negative, that is, when the fouling flag $F_s$ is not "1", the execution of this program is terminated after a non-fouling condition auxiliary routine is executed at step 731.

When the determination at step 730 is affirmative, that is, if the fouling flag $F_s$ is "1", this program is terminated after a fouling condition auxiliary routine is executed in step 732.

Figure 11:
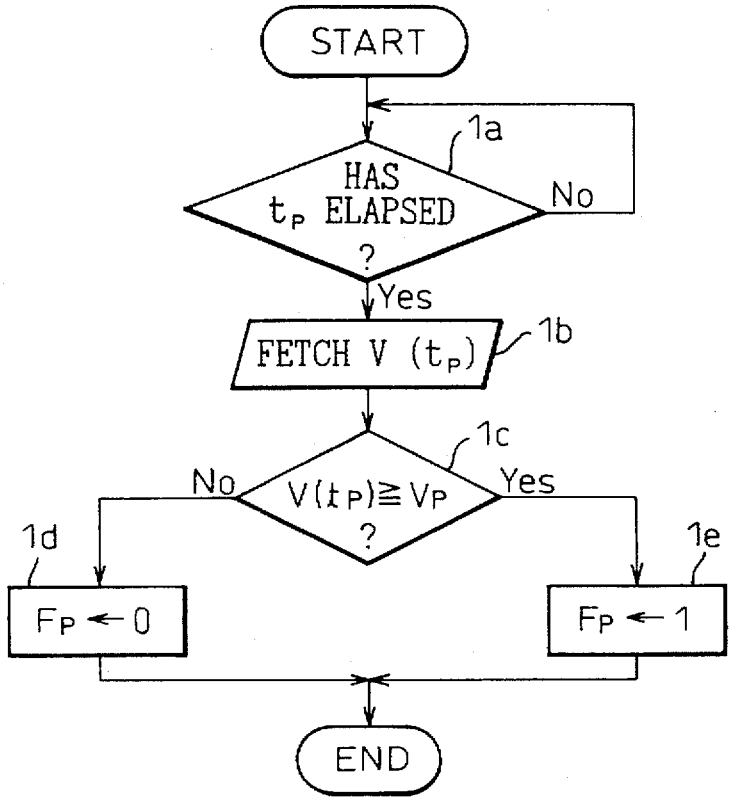
FIG. 11 is a flowchart of an auxiliary routine for a non-fouling period.

FIG. 11 is a flowchart of the non-fouling condition auxiliary routine executed in step 731. At step 1*a*, the control waits until the preignition detecting interval $t_p$ has elapsed. When the preignition detecting interval $t_p$ has elapsed, the determination at step 1*a* is affirmative, and the preignition detecting voltage $V(t_p)$ is read at step 1*b*.

At step 1*c*, it is determined whether or not the preignition detecting voltage $V(t_p)$ is higher than the predetermined preignition detecting threshold voltage $V_p$.

When the determination at step 1*c* is negative, it is determined that no preignition occurs and execution of this auxiliary routine is terminated after a preignition flag is reset to "0".

Conversely, when the determination at step 1*c* is affirmative, it is determined that preignition has occurred, and this auxiliary routine is terminated after the preignition flag $F_p$ is set to "1". Namely, when the ignition plug does not foul, the fouling detecting voltage is not fetched.

Figure 12:
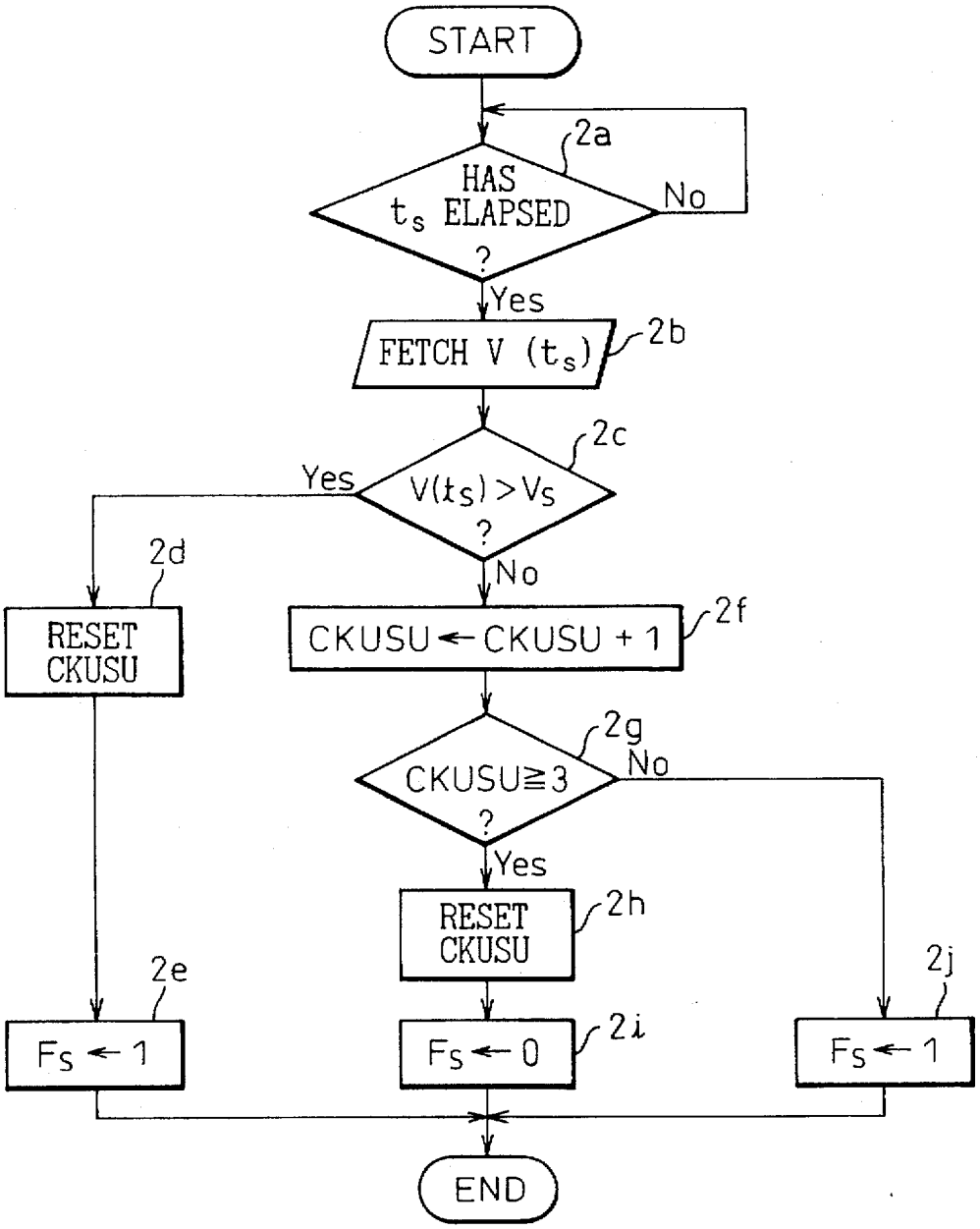
FIG. 12 is a flowchart of an auxiliary routine for a fouling period.

FIG. 12 is a flowchart of the fouling condition time auxiliary routine executed at step 732. At step 2*a*, the control waits until the fouling detecting interval $t_s$ has elapsed. When the fouling detecting interval $t_s$ has elapsed, the determination at step 2*a* is affirmative, and the control proceeds to step 2*b* where the fouling detecting voltage $V(t_s)$ is fetched.

At step 2*c*, it is determined whether or not the fouling detecting voltage $V(t_s)$ is higher than the predetermined fouling detecting threshold voltage $V_s$.

When the determination at step 2*c* is affirmative, it is determined that the ignition plug is fouling. Then, this auxiliary routine is terminated after the counter CKUSU is reset to "0" at step 2*d*, and the fouling flag $F_s$ is set to "1" at step 2*e*.

Conversely, if the determination at step 2*c* is negative, it is determined that the ignition plug is not fouling. Then, the counter CKUSU is incremented at step 2*f*, and it is determined whether or not the counter CKUSU is bigger than a predetermined value, for example, "3" at step 2*g*.

When the determination at step 2*g* is affirmative, namely, when it is determined that the ignition plug has not been fouling while the counter CKUSU is incremented to "3" after the operating condition had been transferred to the high-load condition though the ignition plug fouled at the low-load condition, this auxiliary routine is terminated after the counter is reset at step 2h, and the fouling flag $F_s$ is reset to "0" at step 2j.

When the determination at step 2g is negative, it is determined that the ignition plug is fouling even in the high-load operating condition and this auxiliary routine is terminated after the fouling flag $F_s$ is set to "1".

Note, when the ignition plug is fouling, the preignition detecting voltage is not fetched so as to avoid a misjudgment.

Although the preferred embodiments of the present invention have been described above, it should be understood that the present invention is not limited thereto and that other modifications will be apparent to those skilled in the art without departing from the spirit of the invention.

The scope of the present invention, therefore, should be determined solely by the appended claims.

We claim:

1. A preignition detecting device comprising:

an ignition command signal outputting means for outputting an ignition command signal;

a fouling detecting means for detecting fouling of an ignition plug in accordance with a current which flows from the ignition plug to a ground during a fouling detecting interval contained in a period when the ignition command signal is being outputted by said ignition command signal outputting means;

a preignition detecting means for detecting a preignition in accordance with a current which flows from the ignition plug to a ground when a preignition detecting interval later than the fouling detecting interval contained in a period during the ignition command signal is being outputted by said ignition command signal outputting means; and a preignition detecting inhibiting means for inhibiting a preignition from being detected when fouling of the ignition plug is detected by said fouling detecting means.

2. A preignition detecting device of claim 1, further comprising:

a fouling detecting inhibiting means for inhibiting a fouling from being detected after a preignition has once been detected by said preignition detecting means until a preignition is not detected by said preignition detecting means.

3. A preignition detecting device of claim 1, further comprising:

an operating condition transition detecting means for detecting an operation condition transition from an operation condition except a specific operation condition where preignition often occurs in the specific operating condition; and a means for inhibiting preignition from being detected by said preignition detecting means when fouling of the ignition plug is being detected by said fouling detecting means, and for inhibiting fouling of the ignition plug from being detected by said fouling detecting means and removing inhibiting for a preignition detecting after fouling of the ignition plug has not been detected, after an operation condition transition was detected by said operating condition transition detecting means.

4. A preignition detecting device comprising:

an ignition command signal outputting means for outputting an ignition command signal;

an integrating means for integrating a current which flows from an ignition plug to the ground during a predetermined fixed interval contained in a period when the ignition command signal is being outputted by said ignition command signal outputting means; and a determining means for determining that preignition occurs when an integrated value integrated by said integrating means is smaller than a predetermined fixed fouling threshold level and is bigger than a predetermined fixed preignition threshold level which is smaller than the predetermined fixed fouling threshold level.

5. A preignition detecting method comprising the steps of:

outputting an ignition command signal from an ignition device;

detecting fouling of an ignition plug in accordance with a current which flows from the ignition plug to a ground during a fouling detecting interval contained in a period when the ignition command signal is being outputted by said ignition device;

detecting preignition in accordance with a current which flows from the ignition plug to a ground during a preignition detecting interval later than the fouling detecting interval contained in a period when the ignition command signal is being outputted by said ignition device; and inhibiting a preignition from being detected when a fouling of the ignition plug is detected at said fouling detecting step.

6. A preignition detecting method of claim 5, further comprising a step of:

inhibiting fouling from being detected after a preignition has been detected at said preignition detecting step until preignition is not detected at said preignition detecting step.

7. A preignition detecting method of claim 5, further comprising steps of:

detecting an operation condition transition from an operation condition except a specific operation condition where preignition often occurs in the specific operating condition; and inhibiting preignition from being detected at said preignition detecting step when fouling of the ignition plug is being detected at said fouling detecting step, and for inhibiting fouling of the ignition plug from being detected at said fouling detecting step and removing inhibiting for preignition detecting after a fouling of the ignition plug has not been detected, after a operation condition transition was detected at said operating condition transition detecting step.

8. A preignition detecting method comprising steps of:

outputting an ignition command signal from an ignition device;

integrating a current which flows from an ignition plug to the ground during a predetermined fixed interval contained in a period during the ignition command signal is being outputted by said ignition device; and determining that preignition occurs when an integrated value integrated at said integrating step is smaller than a predetermined fixed fouling threshold level and is bigger than a predetermined fixed preignition threshold level which is smaller than the predetermined fixed fouling threshold level.

* * * * *

UNITED STATES PATENT AND TRADEMARK OFFICE

CERTIFICATE OF CORRECTION

PATENT NO. : 5,751,147
DATED : May 12, 1998
INVENTOR(S) : Koichi NAKATA, et al.

It is certified that error appears in the above-identified patent and that said Letters Patent is hereby corrected as shown below:

Column 2, line 31, change "occur" to --occurs--.

Column 2, line 47, delete"from being caused".

Column 4, line 39, change "for" to --since--.

Column 4, line 20, delete "of".

Column 5, line 48, before "order" insert --in--.

Column 5, line 52, change "internal" to --interval--.

Column 10, line 48, change "a" to --an--.

Column 10, line 56, after "during" insert --which--.

Signed and Sealed this

Twenty-sixth Day of October, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,751,147

DATED : May 12, 1998

INVENTOR(S) : Koichi Nakata; Kazuhisa Mogi and Youichi Kurebayashi

It is certified that error appears in the above-identified patent and that said Letters Patent is hereby corrected as shown below:

On the first page, item [73] Assignee, should read - - Toyota Jidosha Kabushiki Kaisha, Aichi, Japan and Denso Corporation, Aichi-Pref., Japan - -.

Signed and Sealed this

Thirtieth Day of November, 1999

*Attest:*

*Attesting Officer*

Q. TODD DICKINSON

*Acting Commissioner of Patents and Trademarks*